United States Patent [19]

Wyant

[11] Patent Number: 4,807,823

[45] Date of Patent: Feb. 28, 1989

[54] BATHROOM TISSUE DISPENSER

[75] Inventor: James A. Wyant, Pointe Claire, Canada

[73] Assignee: Wyant & Company Limited/La Compagnie Wyant Limitee, Saint Laurent, Canada

[21] Appl. No.: 171,187

[22] Filed: Mar. 18, 1988

Related U.S. Application Data

[63] Continuation of Ser. No. 829,974, Feb. 18, 1986, abandoned.

[51] Int. Cl.[4] ..... B65H 19/04

[52] U.S. Cl. ..... 242/55.3; 242/55.53

[58] Field of Search ..... 242/55.2, 55.3, 55.53; 312/37, 38, 39; 206/390, 391, 397; D6/518, 521, 522, 523

[56] References Cited

U.S. PATENT DOCUMENTS

| | | | |
|---|---|---|---|
| 3,750,971 | 8/1973 | Chevas | 242/55.53 X |
| 3,770,222 | 11/1973 | Jespersen | 242/55.3 |
| 3,948,454 | 4/1976 | Bastian | 242/55.3 |
| 4,179,078 | 12/1979 | Mansfield | 242/55.53 |
| 4,375,874 | 3/1983 | Leotta et al. | 242/55.53 X |

*Primary Examiner*—David Werner

*Attorney, Agent, or Firm*—Fetherstonhaugh & Co.

[57] ABSTRACT

A bathroom tissue dispenser with a top and bottom tissue roll holder, has fixed spindles and a lockable hinged enclosure over the top spindle. The enclosure makes it difficult to remove sheets from the top roll until the bottom roll has been depleted. The dispenser has a rigid construction and is less prone to damage than existing dispensers.

2 Claims, 2 Drawing Sheets

BATHROOM TISSUE DISPENSER

This application is a continuation of application Ser. No. 829,974, filed Feb. 18, 1986, abandoned.

The present invention relates to a bathroom tissue dispenser and more particularly to a dispenser for dispensing sheet material from a bathroom tissue roll. The dispenser has two spindles to hold two rolls, one of the rolls being a reserve roll for dispensing sheets after the first roll is depleted.

Two roll bathroom tissue dispensers are available today, however, most of these dispensers are rather complex having moving parts that invariably stick or are prone to damage due to excessive force or hooliganism, particularly when the dispenser is used in public washrooms.

A reserve roll of bathroom tissue is particularly useful in commercial and public washrooms, as it allows maintenance personnel to maintain the dispensers on a less frequent basis. Some of the two roll dispensers on the market today have a top spindle which drops out of an enclosure either by pressing a button or alternatively being automatically tripped when the lower roll is depleted. Thus the spindles which in some cases are rotating spindles, are loose within the dispenser and are sometimes removed and lost. Dispensers with moving parts do not fare well in public washrooms. It is known that bathroom tissue rolls are often taken from public washrooms and if the spindles can be removed, then this is an encouragement to pilferers.

The present invention provides a bathroom tissue dispenser with a top roll and a bottom roll holder, both of which have fixed spindles and an enclosure over the top spindle so that it is not easy to remove sheets from the top roll until the bottom roll has been depleted. Once the bottom roll is empty, then it is possible to obtain sheets from the top roll. By having a rigid construction with fixed spindles, less damage can occur to the dispenser. Furthermore, the dispenser has a hinged cover which forms an enclosure for the top roll and has an arm extending down to lock the bottom spindle so that a roll cannot be removed from either spindle without unlocking the cover and swinging it open.

The present invention provides a bathroom tissue dispenser for dispensing sheet material from a roll comprising a back plate adapted for attachment to a flat surface; top fixed spindle cantilevered from the back plate positioned below an upper edge of the back plate; bottom fixed spindle cantilevered from the back plate spaced beneath the top spindle and having a free end, both the top spindle and the bottom spindle adapted to each hold a bathroom tissue roll; side members integral with a top portion of the back plate extending on each side of the top spindle, the side members having bottom edges at a level below the top spindle; cover with a top edge having a hinge connection to the upper edge of the back plate, the cover having a top plate integral with a front plate which with the side members forms an enclosure for the top spindle holding a bathroom tissue roll; a central arm in the same plane and integral with the front plate of the cover extending down over the free end of the bottom spindle, and locking means between the central arm of the cover and the free end of the bottom spindle.

In other embodiments, the bottom edges of the side members are at a level which is approximately one half to one inch below a lowest part of the top spindle. The locking means between the central arm of the cover and the free end of the bottom spindle is preferably a key lock with a removable key.

In drawings which illustrate embodiments of the invention;

Figure 1:
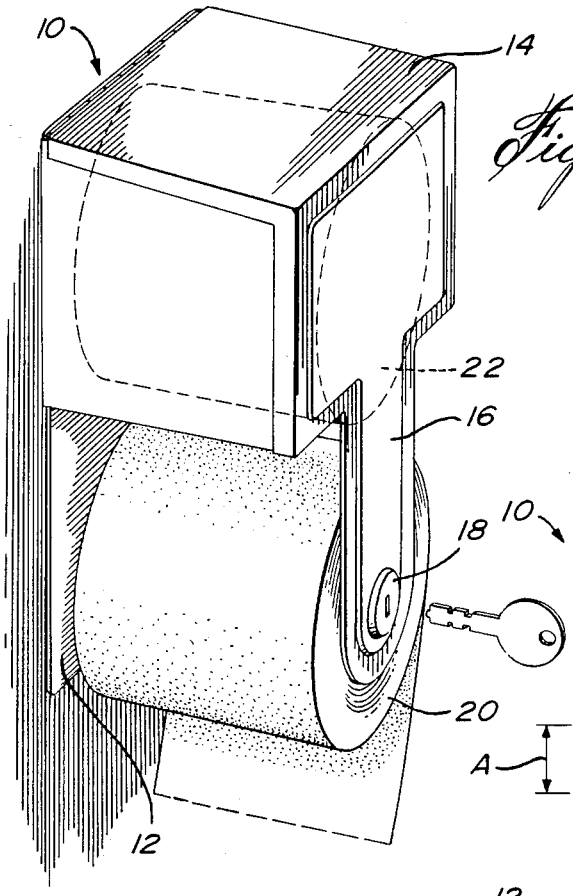
FIG. 1 is an isometric view showing one embodiment of a dispenser according to the present invention.

The bathroom tissue dispenser of the present invention is preferably made from sheet steel to provide a rigid construction that cannot easily be vandalized. As shown in FIG. 1, the dispenser 10 has a back plate 12 and a cover 14 hinged to the top of the back plate 12, which has a central arm 16 extending down to a lock 18 to hold the cover 14 in the closed position. A bottom bathroom tissue roll 20 allows paper sheets to be dispensed easily and a top bathroom tissue roll 22 above the bottom roll 20 is just visible but cannot easily have tissues dispensed until the bottom roll 20 is empty.

Figure 2:
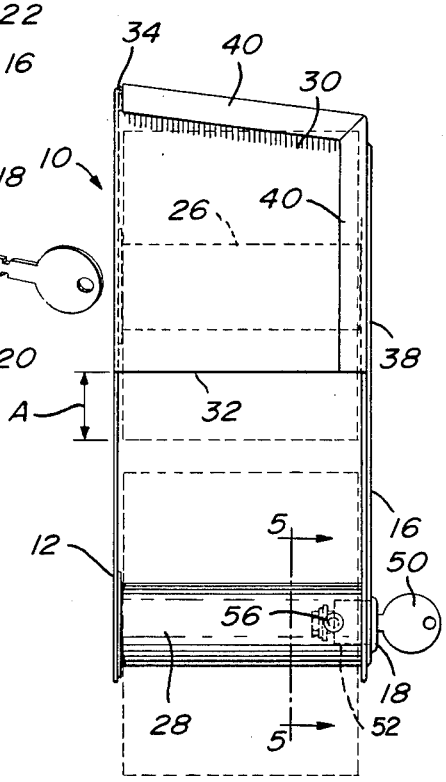
FIG. 2 is a side elevational view of the dispenser shown in FIG. 1 with no bathroom tissue rolls installed.

Details of the dispenser are shown in FIGS. 2. to 4. The back plate 12 is arranged to be mounted on the wall of a compartment and has a top fixed spindle 26 welded to the back plate 12 and cantilevered out therefrom and a bottom fixed spindle 28 welded to the back plate 12 below the top spindle 26 and also cantilevered from the back plate 12. Side members 30 are formed integral with or rigidly attached at the edges of a top portion of the back plate 12, and extend out at right angles from the back plate 12. The bottom edges 32 of the side members 30 are at a level below the lowest part of the top spindle 26 and has a dimension A as shown in the figures. The dimension A is preferably from one half to one inch. It has been found that this distance is sufficient to enable a person to obtain sheets from a paper roll, but generally only after the bottom roll 20 has been depleted.

The cover 14 has a piano hinge 34 at its top edge and has a top plate 36 extending outwards from the hinge 34 so that when closed, the top plate 36 rests on the top edge of the side members 30. The top plate 36 of the cover 14 has a bend at its outer edge and joins to a front plate 38 which with the cover 14 closed, is substantially parallel to the back plate 12. The front plate 38 extends down to the same level as the bottom edge of the side members 30 and the central arm 16 is integral with the front plate 38, and in the same plane. The central arm 16 is not much wider than the diameter of the spindles so that easy access to the top roll 22 is available when the bottom roll 20 is empty. Both the top plate 36 and the front plate 38 of the cover 14 have side flaps 40 or flanges which extend to cover the side members 30 when the cover 14 is closed. Thus with the cover closed, a top enclosure is formed for the top roll 22 and this enclosure represents a rigid structure which cannot easily be deformed or damaged. The front plate 38 and arm 16 as shown have a depressed center surface for increased structural strength.

Figure 5A:
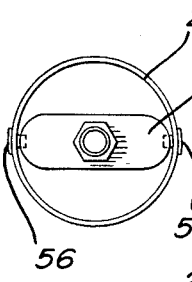
FIGS. 5a and 5b are sectional views taken at line 5—5 of FIG. 2.
Figure 5B:
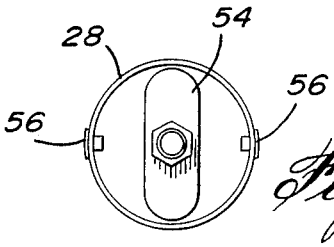
Figure 3:
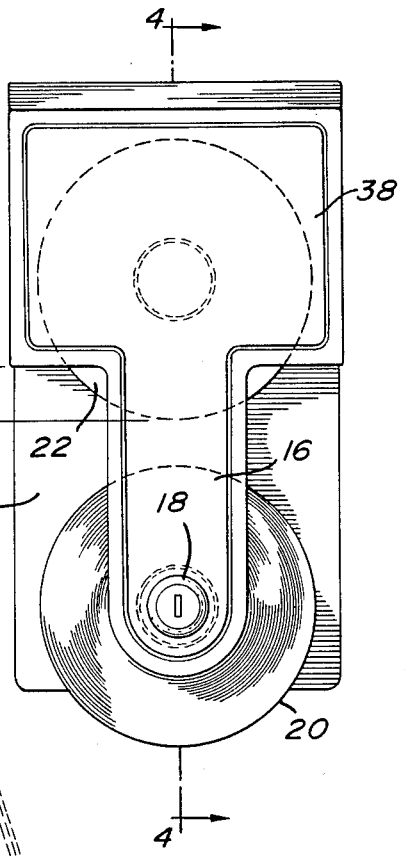
FIG. 3 is a front elevational view of the dispenser shown in FIG. 2 with bathroom tissue rolls installed.
Figure 4:
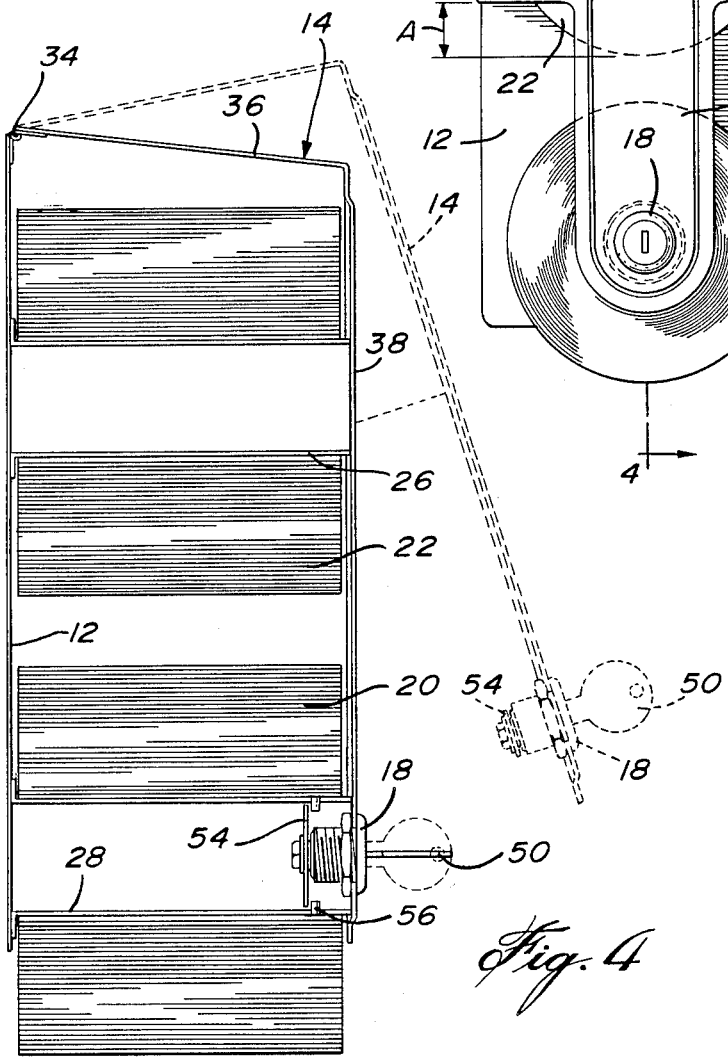
FIG. 4 is a sectional view taken at line 4—4 of FIG. 3.

The key lock 18 has a removable key 50 with the body 52 of the lock extending into the hollow tubular bottom spindle 28. A locking arm 54 is attached to the end of the lock body 52 and rotates through 90 degrees when the key 50 is turned in the lock. Two opposing studs 56 are positioned in a diametrical line across the bottom spindle 28 and are arranged to be engaged by the locking arm 54 as illustrated in FIGS. 5*a* and 5*b*. FIG. 5*a* shows the locking arm in the locked position with the two opposing studs 56 preventing the locking arm 54 from being moved out of the bottom spindle 28, thus the cover 14 is locked in place. FIG. 5*b* illustrates the locking arm 54 rotated through 90 degrees it is in the unlocked position and the cover 14 can be swung open about the hinge 34. By removing the key 50 from the lock 18, the cover 14 is locked to the bottom spindle 28, and the unit becomes a rigid structure.

When both spindles 26 and 28 have bathroom tissue rolls thereon, it is more convenient for the bottom roll 20 to be used, and is awkward for anyone to take sheets from the top roll 22. The side members 32 are designed to make removal of sheets from the top roll 22 difficult, particularly when the bottom roll 20 is full. However, when the bottom roll 20 is depleted, then there is more space to remove sheets from the top roll 22. The bathroom tissue rolls may be replaced by simply unlocking the lock 18 and opening the cover 14. The rolls slide easily over the fixed spindles and can be rotated on the spindles when sheets are dispensed.

Various changes may be made to the embodiments described herein without departing from the scope of the present invention which is limited only by the following claims.

The embodiments of an invention in which an exclusive property or privilege is claimed are defined as follows.

1. A bathroom tissue dispenser for dispensing sheet material from a roll comprising:

a back plate, means in the back plate for use in attaching it to a flat surface;

a top fixed spindle cantilevered from the back plate to form a rigid structure with the back plate and positioned below an upper edge of the back plate;

a bottom fixed spindle cantilevered from the back plate to form a rigid structure with the back plate spaced beneath the top spindle, and having a free end, both the top spindle and the bottom spindle adapted to each hold a bathroom tissue roll;

side members integral with a top portion of the back plate, extending on each side of the top spindle, the side members having bottom edges located one-half to one inch below the top spindle so as to have the side members hide a major portion of the tissue roll mounted on the top spindle and to make it awkward to use the top tissue roll while there is a substantial amount of tissue on the bottom tissue roll, but to make the top tissue roll accessible when the bottom tissue roll is nearly depleted;

a cover with a top edge having a hinge connection to the upper edge of the back plate, the cover having a top plate integral with a front plate, which, with the side members, forms an enclosure for the top spindle and the bathroom tissue roll on the top spindle, a central arm in the same plane and integral with the front plate of the cover extending down over the free end of the bottom spindle, and locking means between the central arm of the cover and the free end of the bottom spindle.

2. The dispenser according to claim 1 wherein the locking means between the central arm of the cover and the free end of the bottom spindle is a key lock with a removable key.

* * * * *